US007243723B2

(12) United States Patent
Surjaatmadja et al.

(10) Patent No.: US 7,243,723 B2
(45) Date of Patent: Jul. 17, 2007

(54) SYSTEM AND METHOD FOR FRACTURING AND GRAVEL PACKING A BOREHOLE

(75) Inventors: Jim B. Surjaatmadja, Duncan, OK (US); David McMechan, Duncan, OK (US); Philip D. Nguyen, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 260 days.

(21) Appl. No.: 10/871,929

(22) Filed: Jun. 18, 2004

(65) Prior Publication Data

US 2005/0279501 A1 Dec. 22, 2005

(51) Int. Cl.
*E21B 43/04* (2006.01)

(52) U.S. Cl. ..... 166/278; 166/308.1; 166/51; 166/177.5

(58) Field of Classification Search ..... 166/205, 166/334.4, 278, 308.1, 51, 177.5, 115, 116, 166/169, 298, 55, 55.1
See application file for complete search history.

(56) References Cited

U.S. PATENT DOCUMENTS 2,814,347 A * 11/1957 MacKnight ..... 166/278
2,906,338 A * 9/1959 Shook ..... 166/278
3,323,361 A 6/1967 Lebourg
3,361,204 A * 1/1968 Howard et al. ..... 166/290
3,430,701 A 3/1969 Canada
3,447,607 A 6/1969 Harris et al.
3,865,188 A 2/1975 Doggett et al.
4,671,352 A 6/1987 Magee et al.
4,714,117 A 12/1987 Dech
5,103,911 A 4/1992 Heijnen
5,161,613 A 11/1992 Jones
5,295,393 A 3/1994 Thiercelin (Continued)

FOREIGN PATENT DOCUMENTS

EP 1 094 195 A2 4/2001

(Continued)

OTHER PUBLICATIONS

Surjaatmadja, Jim B., "SurgiFrac: A Method to Effectively, Accurately and Selectively Place Many Fractures in a Well," paper prepared for presentation at SPE Section Meetings; Nov. 10-11, 1999, 14 pages.

(Continued)

*Primary Examiner*—Kenneth Thompson
(74) *Attorney, Agent, or Firm*—Joshua A. Griswold

(57) ABSTRACT

A system and method for fracturing an earth formation surrounding a borehole includes an elongate conduit positioned in the borehole. A packer assembly is provided about the conduit and is adapted to seal an annulus between the conduit and the borehole. A packing passage is provided and adapted to communicate a first side of the packer assembly to the annulus between the conduit and the borehole on a second side of the packer assembly. The conduit has at least one inlet into the conduit on the second side of the packer assembly adapted to allow flow from outside of the conduit to the interior of the conduit. The conduit has at least one ported sub having at least one lateral jet aperture therein adapted to direct fluids within the conduit into the earth formation to fracture the earth formation.

48 Claims, 8 Drawing Sheets

U.S. PATENT DOCUMENTS

| | | | | |
|---|---|---|---|---|
| 5,381,864 | A | | 1/1995 | Nguyen et al. |
| 5,417,284 | A | | 5/1995 | Jones |
| 5,425,424 | A | | 6/1995 | Reinhardt et al. |
| 5,499,678 | A | | 3/1996 | Surjaatmadja et al. |
| 5,515,915 | A | | 5/1996 | Jones et al. |
| 5,533,571 | A | | 7/1996 | Surjaatmadja et al. |
| 5,560,427 | A | * | 10/1996 | Jones ..... 166/280.1 |
| 5,722,490 | A | | 3/1998 | Ebinger |
| 5,765,642 | A | | 6/1998 | Surjaatmadja |
| 5,848,645 | A | | 12/1998 | Jones |
| 5,947,200 | A | * | 9/1999 | Montgomery ..... 166/281 |
| 6,059,032 | A | | 5/2000 | Jones |
| 6,095,245 | A | | 8/2000 | Mount |
| 6,253,851 | B1 | | 7/2001 | Schroeder, Jr. et al. |
| 6,286,600 | B1 | | 9/2001 | Hall et al. |
| 6,364,017 | B1 | | 4/2002 | Stout et al. |
| 6,382,319 | B1 | | 5/2002 | Hill, Jr. et al. |
| 6,394,184 | B2 | | 5/2002 | Tolman et al. |
| 6,464,006 | B2 | | 10/2002 | Womble |
| 6,481,494 | B1 | | 11/2002 | Dusterhoft et al. |
| 6,488,082 | B2 | | 12/2002 | Echols et al. |
| 6,516,881 | B2 | | 2/2003 | Hailey, Jr. |
| 6,533,037 | B2 | * | 3/2003 | Eslinger et al. ..... 166/319 |
| 6,557,634 | B2 | | 5/2003 | Hailey, Jr. et al. |
| 6,568,474 | B2 | | 5/2003 | George et al. |
| 6,832,654 | B2 | | 12/2004 | Ravensbergen et al. |
| 6,983,795 | B2 | * | 1/2006 | Zuklic et al. ..... 166/51 |
| 7,066,265 | B2 | | 6/2006 | Surjaatmadja |
| 2002/0104650 | A1 | | 8/2002 | Dusterhoft et al. |
| 2003/0062167 | A1 | | 4/2003 | Surjaatmadja et al. |
| 2004/0020832 | A1 | | 2/2004 | Richards et al. |
| 2004/0050551 | A1 | | 3/2004 | Jones |
| 2006/0005964 | A1 | | 1/2006 | Jannise et al. |

FOREIGN PATENT DOCUMENTS

WO WO 2004/063527 A1 7/2004

OTHER PUBLICATIONS

Halliburton Fracturing, "SurgiFrac$^{SM}$ Service—Fracture Stimulation Technique for Horizontal Completions in Low- to Medium-Permeability Reservoirs," copyright 2003, 6 pages.

Field Development Frac Pack Gas Processing, Interview with 2004 SPE President Kate H. Baker, Journal of Petroleum Technology, Sep. 2003, 3 pages.

Jannise, Ricki, "Review of BJ Services Reduced Trip Gravel Pack System," Presentation by Ed Smith with BJ Services Formerly With OSCA and Amoco, Apr. 6, 2003, 3 pages.

Surjaatmadja, Jim B., U.S. Patent Application entitled, "Downhole Completion System and Method for Completing a Well," filed Jun. 18, 2004, 53 pages.

Golla et al., U.S. Patent Application entitled, "Method and Apparatus for Mud Pulse Telemetry," U.S. Appl. No. 10/619,197, filed Jul. 14, 2003, 24 pages.

Notification of Transmittal of the International Search Report and the Written Opinion of the International Searching Authority, or the Declaration (3 pages), International Search Report (4 pages), and Written Opinion of the International Searching Authority (6 pages) for International Application No. PCT/US2005/021069 mailed Oct. 19, 2005.

Notification Concerning Transmittal of Copy of International Preliminary Report on Patentability (1 page) and International Preliminary Report on Patentability (6 pages) for International Application No. PCT/US2005/021069 dated Jan. 4, 2007.

* cited by examiner

SYSTEM AND METHOD FOR FRACTURING AND GRAVEL PACKING A BOREHOLE

TECHNICAL FIELD

This invention relates to completing a well in an earth formation, and more particularly to a system and method for fracturing the earth formation and gravel packing the well borehole.

BACKGROUND

Fracturing and gravel packing a borehole using conventional systems requires multiple trips in and out of the borehole to place, utilize, and remove equipment. For example, the equipment used in fracturing, such as a straddle packer system, is be run into the borehole, operated to fracture at a first position in the borehole, moved and operated to fracture at one or more subsequent positions in the borehole, and then removed. Thereafter, a production string having a gravel pack screen and washpipe assembly is run into the borehole, and the annulus between the gravel pack screen and the borehole is gravel packed. Finally, the washpipe must be removed from the borehole before production can begin. In each trip into and out of the borehole, the equipment must travel many thousands of feet. The trips can accumulate days and even weeks onto the time it takes to complete the well. During this time, costs accrue as crews and equipment must be on site to perform the operations. Furthermore, the time spent tripping into and out of the borehole delays the time in which the well begins to produce, and thus begins to payback the expenses outlaid in drilling the well. If the time required to fracture and gravel pack the borehole can be reduced, the well may be more profitable. One manner to reduce this time is to refine the fracturing and gravel packing processes to reduce the number of trips into and out of the borehole.

Accordingly, there is a need for a system and method of fracturing and gravel packing a well that requires a reduced number of trips into and out of the borehole.

SUMMARY

The present invention encompasses a system and method for fracturing and gravel packing a borehole that can require as few as one trip into and one trip out of the well.

One illustrative implementation is drawn to a system for fracturing an earth formation surrounding a borehole. The system includes a conduit adapted for fixed installation in the borehole. A flow assembly is provided for selectively communicating between the flow assembly and an interior of the conduit and between the flow assembly and an annulus between the conduit and the borehole. At least one ported sub is coupled to the conduit and has at least one substantially lateral aperture therein. The substantially lateral aperture is adapted to communicate fluids within the conduit into the borehole to fracture the earth formation. A substantially tubular internal fracturing assembly is insertable into the interior of the ported sub. The internal fracturing assembly is adapted to communicate an interior of the internal fracturing assembly to one or more of the lateral apertures.

Another illustrative implementation is drawn to a method of fracturing and gravel packing a borehole in an earth formation. In the method a completion string is positioned in a borehole. The completion string has at least one filter assembly adapted to filter entry of particulate from an exterior of the completion string into an interior of the completion string and at least one fracturing sub. A gravel packing slurry is flowed around the at least one filter assembly into the annulus between the completion string and the borehole. The earth formation is fractured with the at least one fracturing sub. Fluids are produced from the earth formation through the completion string.

Another illustrative implementation is drawn to a method of fracturing an earth formation. According to the method, a completion string is positioned in a borehole. An annulus between the completion string and the borehole is gravel packed. Fluids are produced from the earth formation through the completion string. Production of fluids from the earth formation is ceased. Without removing the completion string, the earth formation is fractured.

The details of one or more implementations of the invention are set forth in the accompanying drawings and the description below. Other features, objects, and advantages of the invention will be apparent from the description and drawings, and from the claims.

DESCRIPTION OF DRAWINGS

FIG. 11A is a schematic cross-sectional view of an illustrative fracturing and gravel packing system in accordance with the invention;

Like reference symbols in the various drawings indicate like elements.

DETAILED DESCRIPTION

Figure 1A:
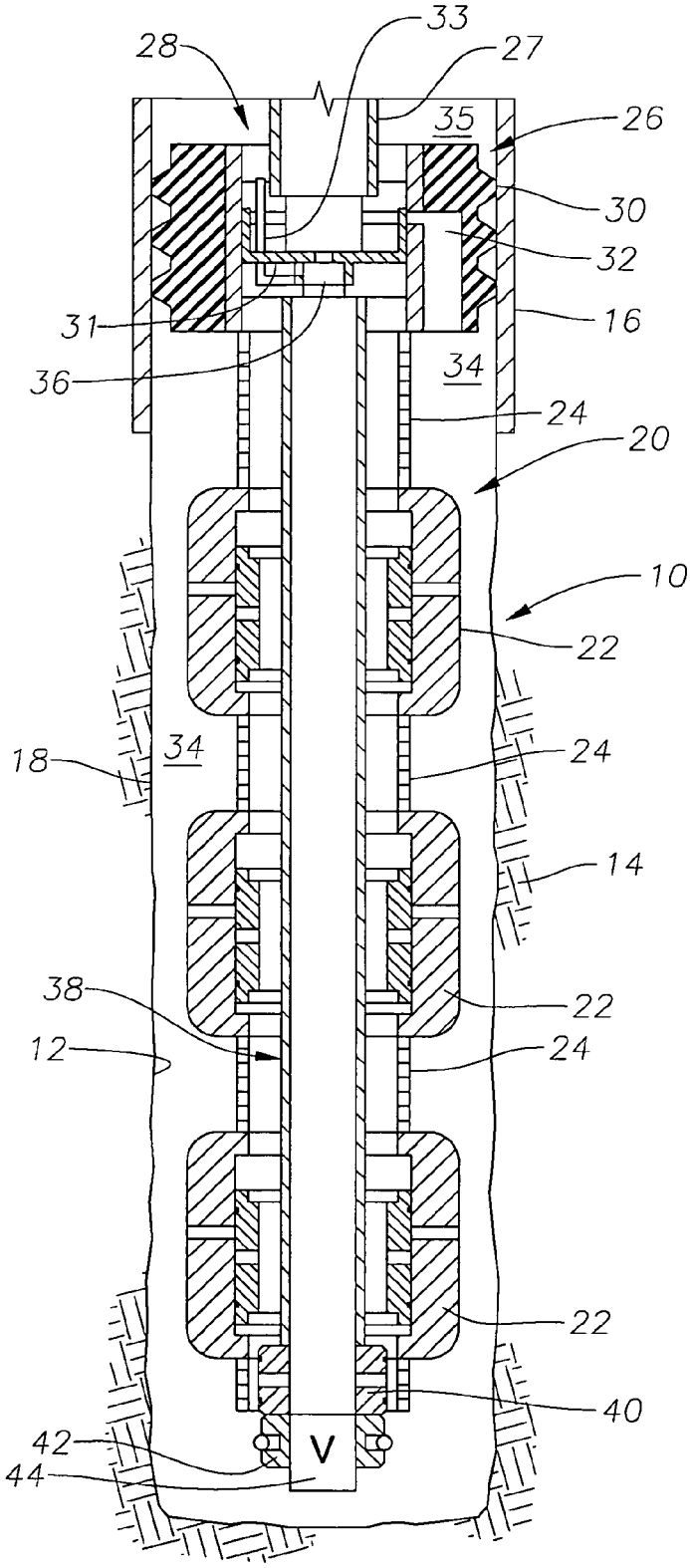
FIG. 1B is a schematic cross-sectional view of another illustrative fracturing and gravel packing system in accordance with the invention incorporating alternate flow paths.
FIG. 1C is a cross-sectional view of the illustrative fracturing and gravel packing system of FIG. 1B.
Figure 1B:
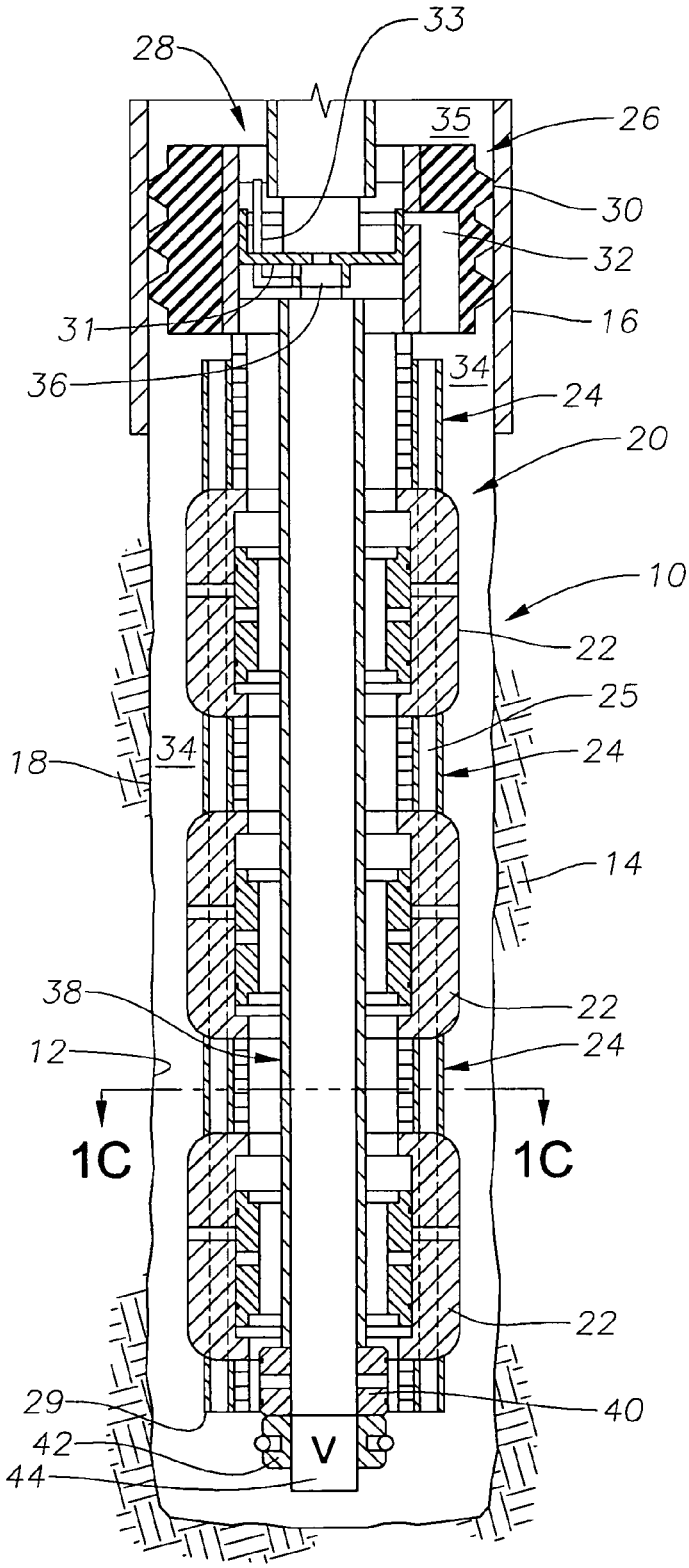

Referring first to FIGS. 1A and 1B, a fracturing and gravel packing system 10 in accordance with the invention is depicted residing in a borehole 12 in an earth formation 14. A substantially tubular casing 16 extends downward from the surface (not specifically shown) into and through at least a portion of the borehole 12 and leaves a length of the borehole 12 uncased (i.e. open hole portion 18). Although depicted in FIGS. 1A and 1B as extending vertically and straight through the earth formation 14, the borehole 12 may at some point curve, or deviate, to extend in another direction. For example, the borehole 12 may deviate to extend substantially horizontally. The fracturing and gravel pack system 10 includes a substantially tubular lower completion conduit or string 20 that is run-in from the surface through the borehole 12 to extend beyond, or below, the end of the casing 16. The lower completion string 20 includes, among other components, one or more fracturing subs 22 mounted inline between other components and is adapted for extended production of fluids from the borehole 12 (i.e. for use in producing the well). The illustrative implementations of FIGS. 1A and 1B include sections of tubular sand control assembly 24 mounted inline between the fracturing subs 22. The sand control assemblies 24 are sections of slotted pipe or composite screens operable to allow communication of fluid between the interior and exterior of the sand control assembly 24 while also substantially filtering particulate, particularly gravel and sand, from entry into the interior of the lower completion string 20.

Figure 1C:
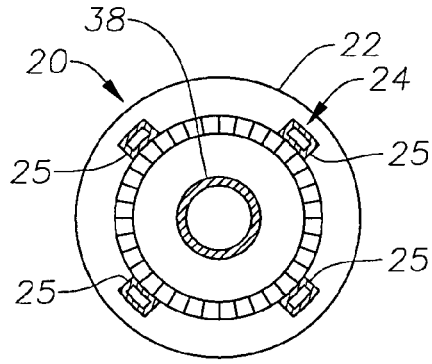

The illustrative implementation of FIG. 1B, also depicted in cross section in FIG. 1C, further incorporates one or more alternate flow or shunt paths 25 in the sand control assembly 24. The shunt paths 25 are tubular passages that provide an alternate flow route for fluids, such as gravel packing slurry, through the lower completion string 20. Each shunt path 25 will have one or more exit ports 29 distributed about the lower completion string 20 to distribute the flow therein into the annulus between the borehole 12 and the lower completion string 20. If more than one shunt path 25 is included, the shunt paths 25 may be of varying length to supply fluid to different portions of the lower completion string 20. The shut paths 25 may be incorporated between layers of a multi-layer screen assembly 24.

Referring again to FIGS. 1A and 1B, the fracturing subs 22, as will be described in more detail below, operate to selectively create fractures in the earth formation 14 surrounding the borehole 12 and depositing particulate material, typically graded sand or man-made proppant material, in the fractures to keep the fractures from closing. A fracturing sub 22 can be provided in the lower completion string 20 at each desired position of fracturing, or at a single point if only one fracture position is desired. The illustrative implementations of FIGS. 1A and 1B are configured with three fracturing subs 22 to fracture the formation in three positions.

In the illustrative implementation of FIGS. 1A, 1B, and 4–6, a packer system 26 and crossover tool 28 are also provided inline in the lower completion string 20. The packer system 26 may be separate from or integrated with the crossover tool 28. The packer system 26 is adapted to connect with a working string 27 that is run-in from the surface. One or more sealing elements 30 are provided on the exterior of the packer system 26 and are actuatable into sealing contact with the interior of the casing 16. With the sealing elements 30 actuated into sealing contact with the casing 16, the packer system 26 thus substantially seals the annulus 34 between the lower completion string 20 and the casing 16 against fluid flow. The sealing elements 30 can be actuatable into sealing contact with the interior of the casing 16 in one or more various manners of actuating packers, for example via wireline, by mechanical manipulation of the working string 27, or by hydraulic inflation. The lower completion string 20 is configured to position the packer system 26 within the interior of the casing 16 when the lower completion string 20 is received in the borehole 12. It will be appreciated by those skilled in the art that additional packer systems 26 actuatable into sealing contact with the borehole 12 may be provided within the lower completion string 20 between one or more sand control assemblies 24 to define multiple production intervals of the formation 14.

The crossover tool 28 includes a selectively closeable lateral crossover passage 32 for communicating fluids from the working string 27 to an annulus 34 between the lower completion string 20 and the interior of the borehole 12, beyond, or below, the seal made by the packer system 26. The crossover passage 32 can be actuatable in one or more various manners of actuating downhole tools as known in the art, for example by mechanical manipulation of the crossover tool 28 with the working string 27, to allow passage of fluids into the annulus 34 or to seal against passage of fluids into the annulus 34. The crossover tool 28 further includes a closable returns passage 33 for communicating fluids through the crossover tool 28 to the annulus 35 between the working string 27 and the casing 16, and a closable axial passage 36 for communicating fluids axially through the crossover tool 28, for example, from an interior of the working string 27 to an interior of the completion string 20. The returns passage 33 and axial passage 36 may be actuated in one or more various manners of actuating downhole tools as known in the art, for example, by wireline or mechanical manipulation of the crossover tool 28 with the working string 27.

The illustrative implementation depicted in FIGS. 1A, 1B, and 4–6 is a crossover tool 28 that is actuated mechanically. The crossover tool 28 includes a sealing sleeve 31 adapted to reciprocate between a first position (FIG. 1A) substantially sealing lateral crossover passage 32 and returns passage 33 and a second position (FIG. 4) allowing flow from the interior of the crossover tool 28 into the lateral crossover passage 32 and allowing flow through the returns passage 33. The sealing sleeve 31 defines a portion of the axial passage 36. The sealing sleeve 31 is biased into the first position, and is adapted to receive a sealing ball 37 to substantially seal the axial passage 36. Furthermore, the sealing sleeve 31 is adapted moves from the first position to the second position from the weight of the sealing ball 37. It is within the scope of the invention to use other configurations of crossover tools 28.

Figure 2A:
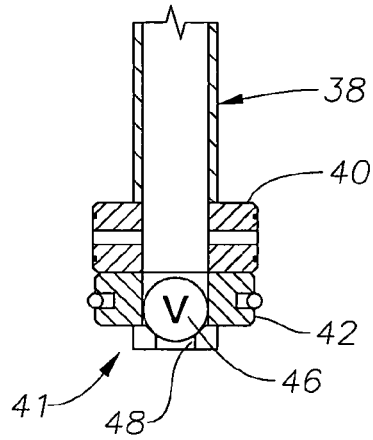
FIG. 2A is a schematic cross-sectional view of an illustrative valve and actuator suitable for incorporation into the fracturing and gravel packing system of FIGS. 1A and 1B.
Figure 2B:
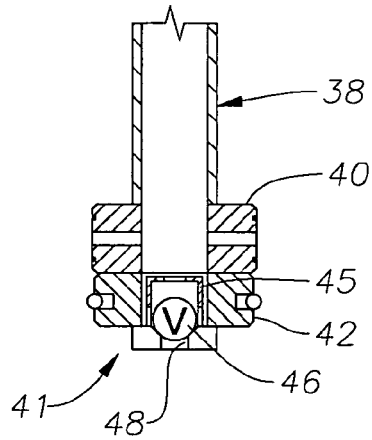
FIG. 2B is a schematic cross-sectional view of an alternate illustrative valve and actuator suitable for incorporation into the fracturing and gravel packing system of FIGS. 1A and 1B

A substantially tubular internal fracturing assembly 38 extends from the crossover tool 28 beyond, or below, the lowest fracturing sub 22. The internal fracturing assembly 38, depicted in greater detail in FIGS. 3A and 3B, includes a fracture mandrel 40, a drag block 42, and optionally a valve 44 distal from the crossover tool 28. The valve 44 is actuatable between a closed position that sealingly closes the end of the internal fracturing assembly 38 and an open position that allows fluid flow through the end of the internal fracturing assembly 38. In one implementation, depicted in FIG. 2A, the valve 44 is a sealing ball 46 that is absent from the internal fracturing assembly 38 when it is desired that the valve 44 be open. Sealing ball 46 is released into the interior of the internal fracturing assembly 38 from the surface pumped down the work string, and lands in shoulder 48 of valve 44 when it is desired that the valve 44 be closed. Optionally, as seen in FIG. 2B, the sealing ball 46 may be captured in a cage 45. The cage 45 enables the sealing ball 46 to act as a check valve, moving to seal the end of the internal fracturing assembly 38 when flow from the interior of the internal fracturing assembly 38 begins to flow out and moving to allow flow through the end of the internal fracturing assembly 38 when flow outside of the internal fracturing assembly 38 begins to flow in. Alternately, the valve 44 can be omitted and the end of the internal fracturing assembly 38 may be blind or open. Inclusion of a valve 44 enables the internal fracturing assembly 38 to function as a washpipe during gravel packing operations (discussed below).

Figure 3A:
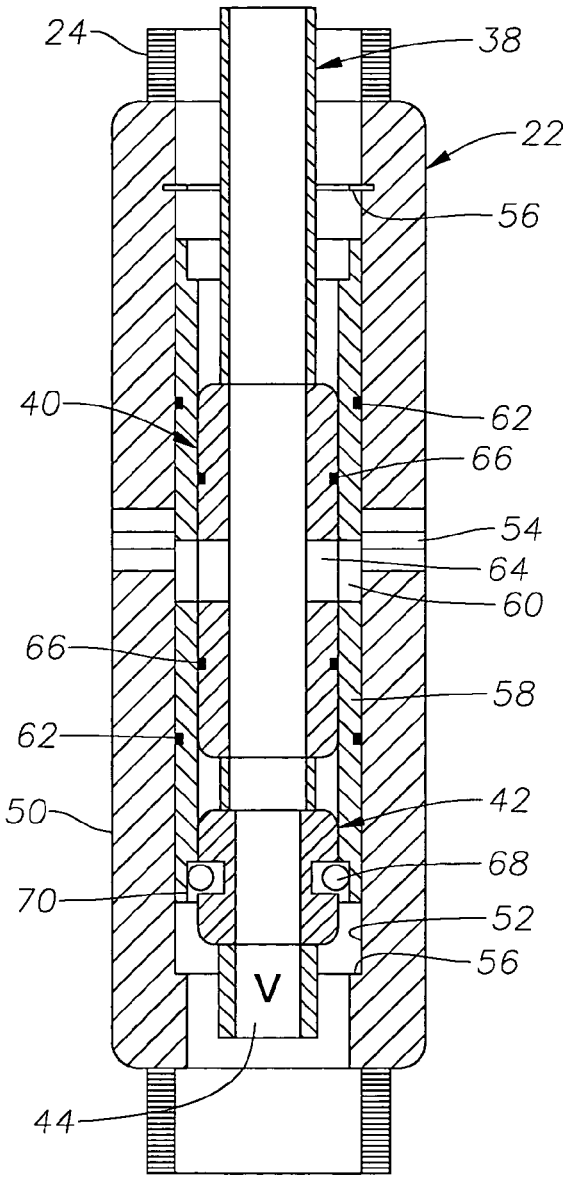
FIG. 3A is a schematic detail of an illustrative fracture sub and internal fracturing assembly in accordance with the invention.
Figure 3B:
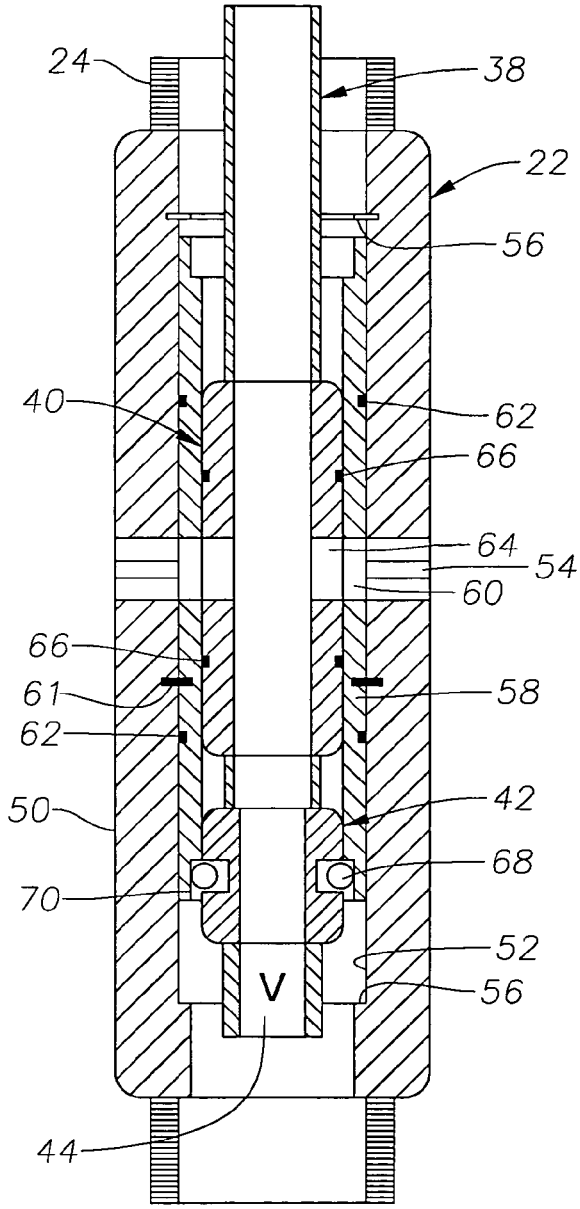
FIG. 3B is a schematic detail of an illustrative fracture sub having a shear pin and an internal fracturing assembly in accordance with the invention.

Referring now to FIGS. 3A and 3B, the fracturing sub 22 has a substantially tubular body portion 50 with an internal bore 52. One or more apertures or jetting apertures 54 pass laterally through the body portion 50. The jetting apertures are configured to jet pressurized fluid within the fracturing sub 22 into the earth formation to hydraulically fracture the formation. A shoulder 56 is provided at each end of the internal bore 52 to internally retain a substantially tubular sleeve member 58. The shoulder 56 may be integral with the body portion 50, for example formed with, cut into, or welded to the body portion 50, or may be provided as a separate part removably engaging the body portion 50, for example as a circlip or snap ring, J-lock profile, ball lock, removable stub, or a removable sub-portion of the body portion 50.

The sleeve member 58 is configured to slide axially within the internal bore 52. One or more windows 60 are provided in the sleeve members 58 and are configured to substantially coincide with the jet apertures 54 or to not coincide with the jet apertures 54 depending on the position of the sleeve member 58 in the internal bore 52. The number of windows 60 need not correspond to the number of jet apertures 54, for example, the one window 60 may span more than one jet aperture 54 or vice versa. Seals 62 are provided above and below the windows 60 to substantially seal against passage of fluid. In the illustrative implementation of FIG. 3A, the sleeve member 58 is configured such that when an upper end of the sleeve member 58 abuts the upper shoulder 56, the windows 60 substantially coincide with the jet apertures 54. In the illustrative implementation of FIG. 3B, the sleeve member 58 is locked to the fracturing sub body 50 with the windows 60 substantially coinciding with the jet apertures 54 by a shear pin 61. When the shear pin 61 is broken, the sleeve member 58 can be moved, so that the windows 60 do not substantially coincide. The sleeve member 58 can be configured such that when an upper end of the sleeve member 58 abuts the upper shoulder 56, the windows 60 substantially coincide with the jet apertures 54. The drag block 42 is adapted to engage the sleeve member 58, so that the sleeve member 58 and drag block 42 move together as a unit.

The drag block 42 is further adapted to disengage from the sleeve member 58 and pass through its interior. In the illustrative implementation of FIGS. 3A and 3B, one or more ball locks 68 on the exterior of the drag block 42 engage a mating profile 70 on the interior of the sleeve member 58. The mating profile 70 provides a detent into which the outwardly biased ball locks 68 are received to join, or engage, the drag block 42 to the sleeve member 58. The mating profile is configured to release, or disengage, the ball locks 68 when the drag block 42 is rotated clockwise relative to the sleeve member 58. Once disengaged from the mating profile 70, the ball locks 68 are retracted into the drag block 42 allowing the drag block 42 to pass through the interior of the sleeve member 58. The mating profile 70 can be provided only on the lower end of the sleeve member 58, or on both ends of the sleeve member 58 as is depicted in FIGS. 3A and 3B. The invention is not limited to the particular ball lock configuration described above, but can utilize any of various other configurations operable to selectively engage and disengage the drag block 42 and sleeve member 58, for example, by J-lock, actuatable collets, or other configurations known to one skilled in the art.

The fracture mandrel 40 includes one or more windows 64 configured to coincide with the windows 60 of the sleeve member 58 or to not coincide with the windows 60 of the sleeve member 58 depending on the position of the fracture mandrel 40 in relation to the sleeve member 58. The number of the windows 64 need not correspond to the number of windows 60 in the sleeve member 58, for example, one fracture mandrel window 64 may span more than one sleeve member window 60 or vice versa. Seals 66 are provided above and below the windows 64 in the fracture mandrel 40 to substantially seal against passage of fluid. In the illustrative implementation of FIG. 3, the fracture mandrel 40, drag block 42, and sleeve member 58 are configured such that when the drag block 42 engages the sleeve member 58, as described above, the windows 64 of the fracture mandrel 40 substantially coincide with the windows 60 of the sleeve member 58.

Referring again to FIGS. 1A and 1B, in operation, the lower completion string 20 containing one or more fracturing subs 22 is run-in the borehole 12, for example, on a working string 27. The number and position of the fracturing subs 22 in the lower completion string 20 correlates to the number and position of desired fracture positions in the borehole 12. The internal fracturing assembly 38 is run-in within the lower completion string 20 and positioned such that the drag block 42 is below the lowest fracturing sub 22. During running-in the interior of the borehole 12 can optionally be washed by flowing fluid downward through the working string 27, through the axial passage 36 of the crossover tool 28 into the borehole 12 below the packer system 26, and back up the walls of the borehole 12. Alternatively, or sequenced with flowing fluid downward through the working string 27, fluids can be flowed down the annulus 35 on the exterior of the working string 27 past the packer system 26 and back up the interior of the working string 27.

The packer system 26 is actuated to seal against the interior of the casing 16. The crossover tool 28 is actuated to flow from the interior of the working string 27, through lateral crossover passage 32, and into the annulus 34 between the lower completion string 20 and the borehole wall 12. In the illustrative implementation of FIGS. 1A and 1B, the crossover tool 28 is actuated by introducing the sealing ball 37 through the working string 27 to land in and seal the axial passage 36, as well as move the sealing sleeve 31 to allow flow through the lateral passage 32 and the returns passage 33.

Figure 4:
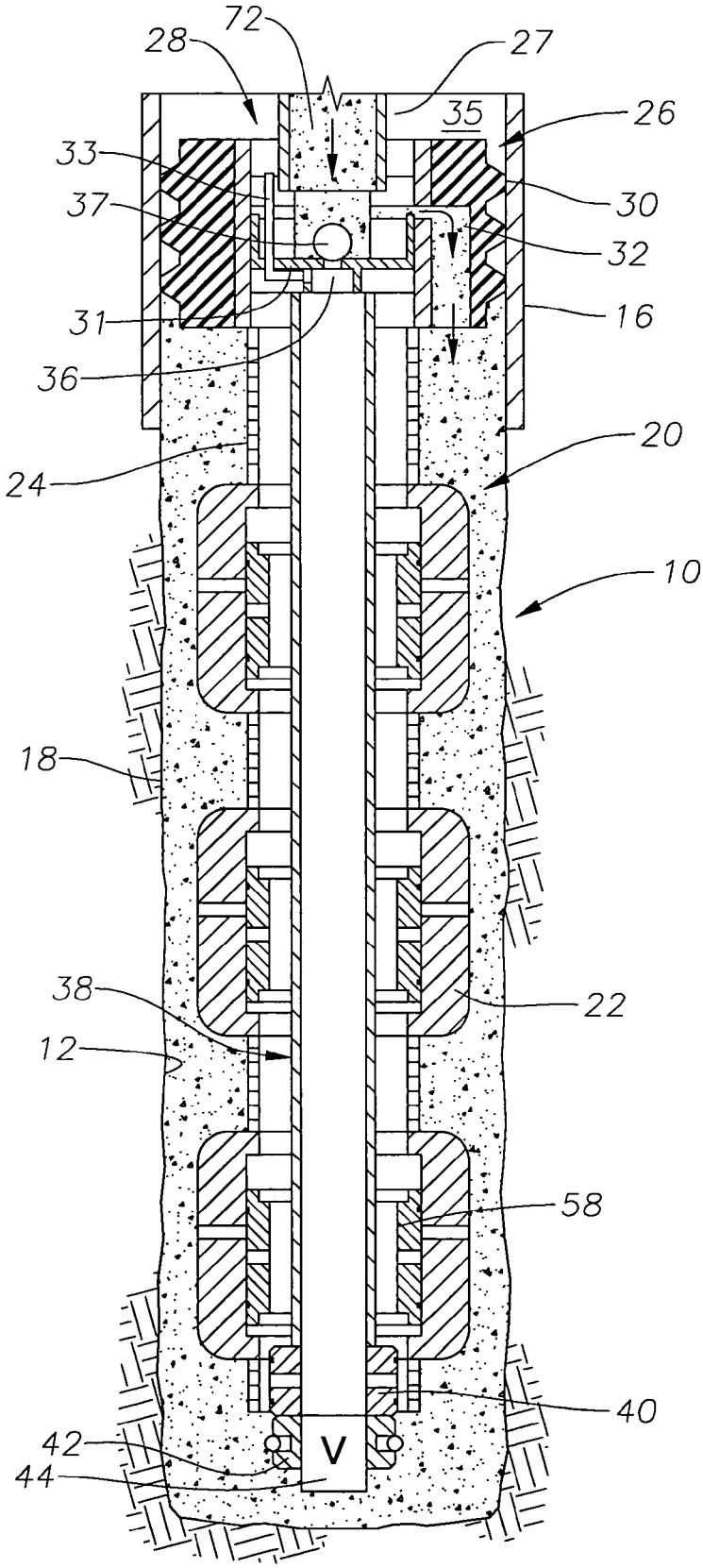
FIGS. 4–7 are sequential views showing operation of the illustrative fracturing and gravel packing system of FIG. 1A.

As depicted in FIG. 4, a gravel packing slurry 72, typically graded sand or man-made material, is introduced through the working string 27, through the lateral crossover passage 32 of the crossover tool 28, and into the annulus 34 between the lower completion string 20 and the borehole 12. The valve 44 at the base of the internal fracturing assembly 38 is opened thereby enabling the internal fracturing assembly 38 to operate as a washpipe to flow returns upward through the returns passage 33. Alternately, the fracture mandrel 40 is positioned with the windows 64 unobstructed such that returns can flow in through windows 64 and no valve 44 need be provided. In either instance, as gravel is deposited in the annulus 34, the returns pass through the sand control assemblies 24 into the interior of the lower completion string 20, and flow through the internal fracturing assembly 38, through the returns passage 33 of the crossover tool 28, and into the annulus 35 between the working string 27 and the casing 16. In an implementation having shunt paths 25 (see FIG. 1B), the shunt paths 25 provide an alternate flow path for gravel slurry during the gravel packing process if, for example, a sand bridge forms in the annulus between the sand control assembly 24 and the borehole 12 and blocks flow through the annulus 34.

Upon completion of gravel packing of the annulus 34, the crossover tool 28 is actuated to close the crossover passage 32 and allow flow through the axial passage 36. Valve 44 (if provided) is also actuated closed. In the illustrative implementation of FIG. 4, the crossover tool 28 is actuated closed by drawing fluid upward through the working string 27 to draw the sealing ball 37 out of the crossover tool 28 and recover it to the surface. Removing the sealing ball 37 enables flow through the axial passage 36 and enables the sealing sleeve 31 to move to the first position to seal the lateral passage 32 and the returns passage 33. Prior to fracturing the formation 14, the crossover tool 28 is drawn upward out of the packer system 26 to allow flow from beneath or beyond the packer system 26 into the annulus 35 between the working string 27 and the borehole 12 (FIG. 5).

Figure 8:
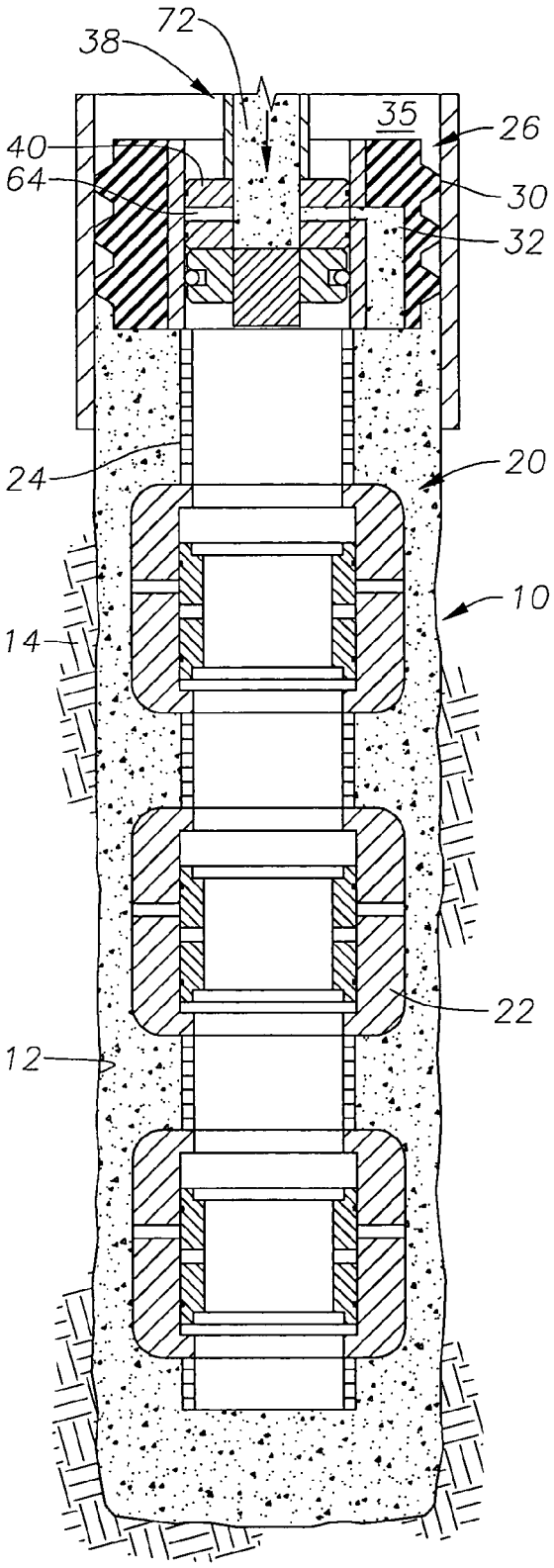
FIG. 8 is a schematic cross-sectional view of a fracturing and gravel packing system gravel packing the borehole without a crossover tool.
Figure 9:
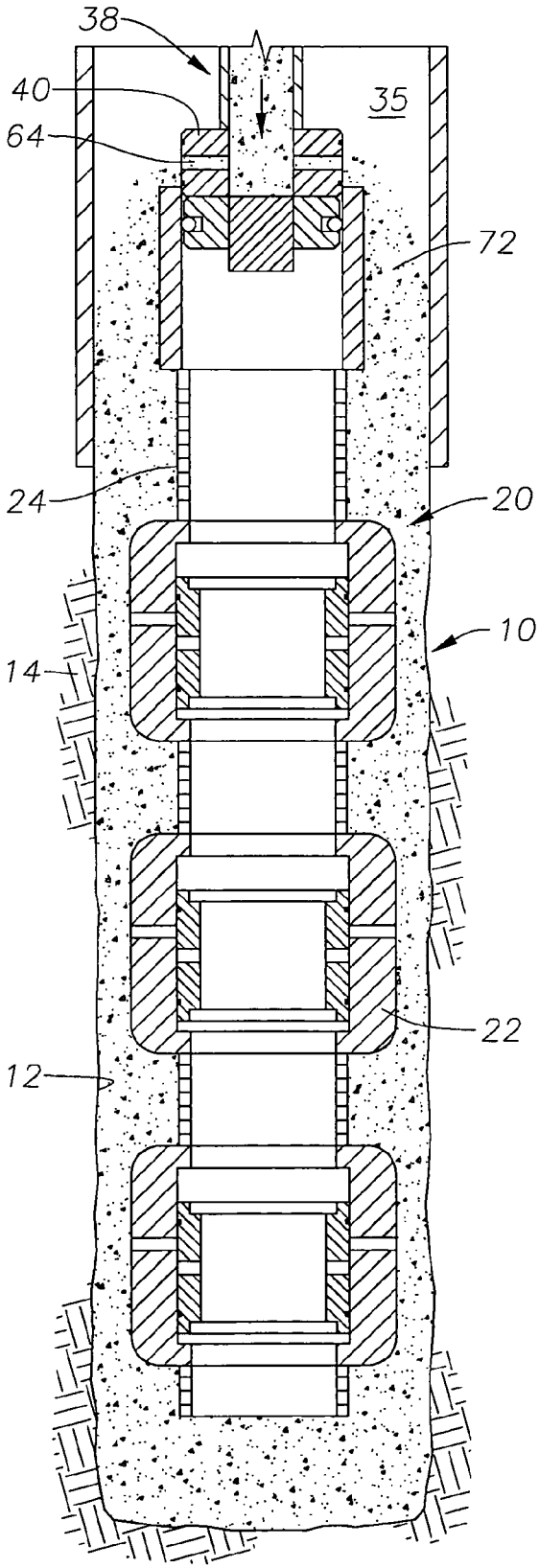
FIG. 9 is a schematic cross-sectional view of a fracturing and gravel packing system gravel packing the borehole without a crossover tool or packer system.

Although gravel packing the borehole 12 is described above utilizing a crossover tool 28, the crossover tool 28 can be omitted and the borehole 12 gravel packed using the internal fracturing assembly 38 as depicted in FIG. 8 or 9. FIG. 8 depicts a lower completion string 20 without a crossover tool, but having a packer system 26 with a lateral crossover passage 32 that communicates fluid between an interior of the packer system 26 and the annulus 34 beyond the packer system 26 and between the lower completion string 20 and the borehole 12. The internal fracturing assembly 38 is used to direct gravel packing slurry 72 through the lateral crossover passage 32 and into the annulus 34 by positioning the window 64 of the fracture mandrel 40 to coincide with the crossover passage 32. Thereafter, gravel packing slurry 72 is flowed through the interior of the internal fracturing assembly 38, through window 64, into the lateral crossover passage 32, and into the annulus 34 between the lower completion string 20 and the borehole 12.

FIG. 9 depicts a lower completion string 20 without a crossover tool or packer system. In this instance, the lower completion string 20 is positioned loosely at the bottom of the borehole 12. The internal fracturing assembly 38 is positioned above the lower completion string 20 and gravel packing slurry 72 is introduced through the internal fracturing assembly 38 and flows out the windows 64 over the outside of the completion string 20 and into the annulus 34 between the completion string 20 and the borehole 12.

Figure 5:
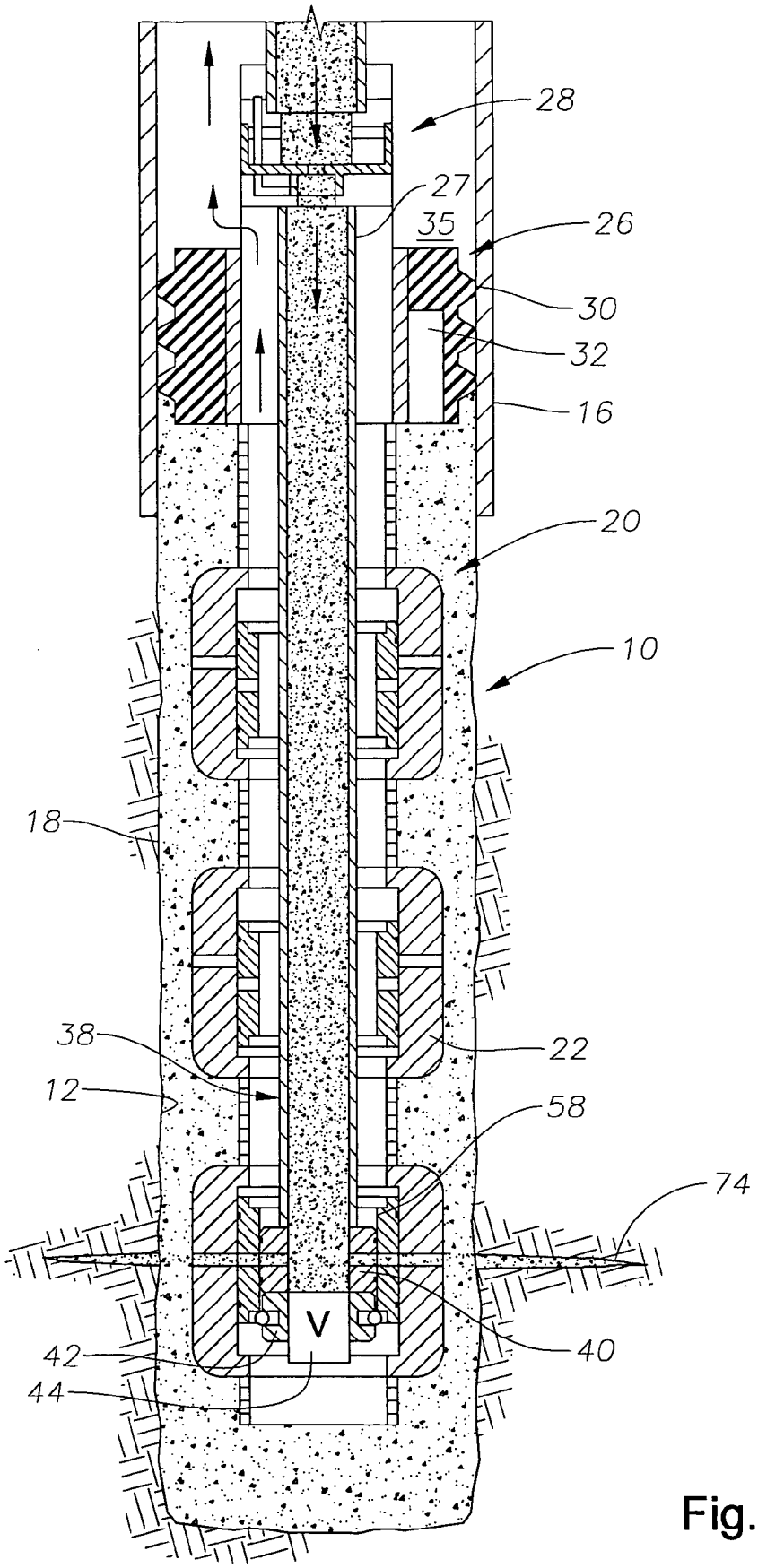
Figure 6:
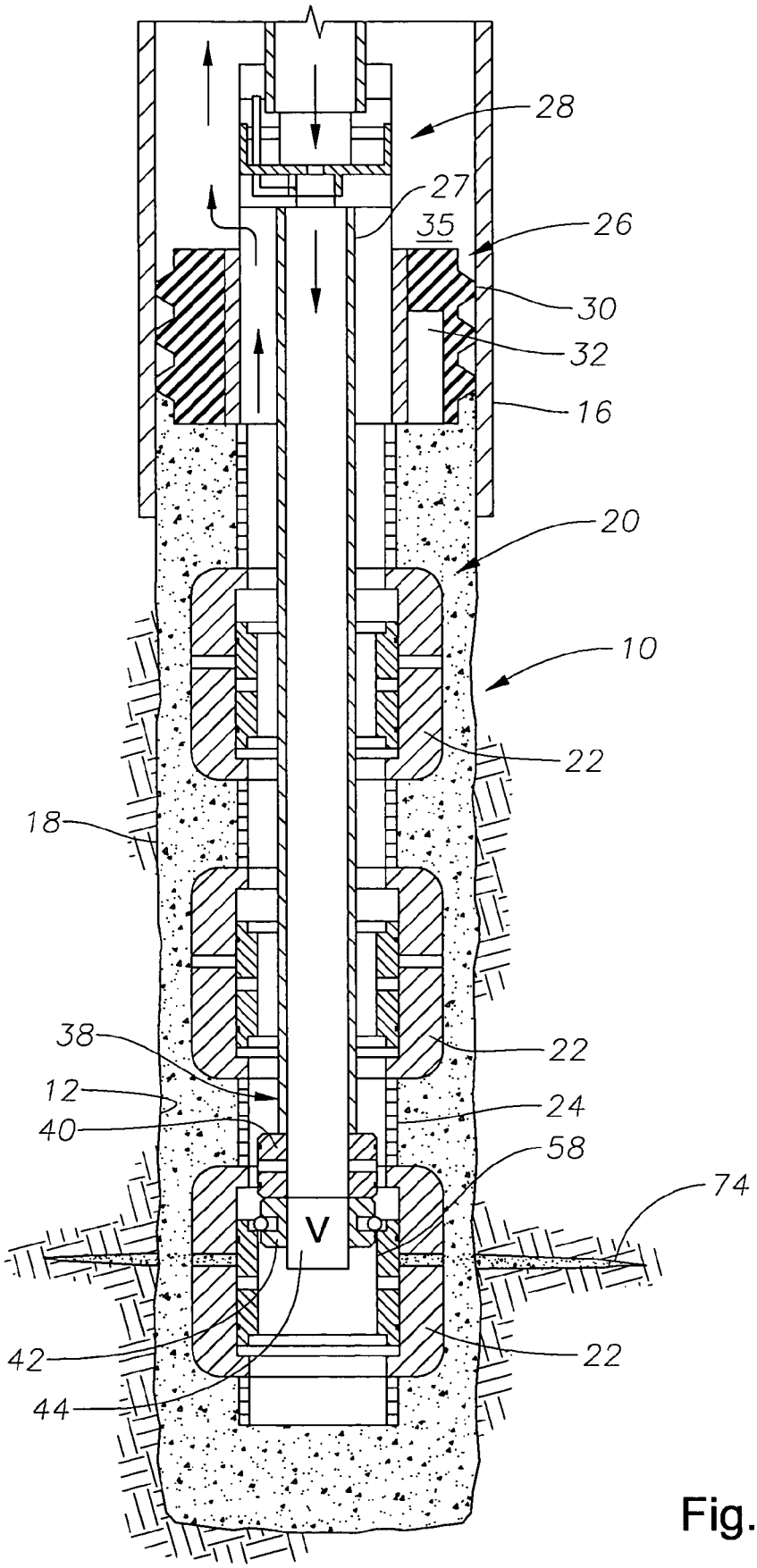

Referring to FIG. 5, the formation 14 is fractured using one or more of the fracturing subs 22 together with the internal fracturing assembly 38. To fracture the formation 14 in a single position, the fracture mandrel 40 of the internal fracturing assembly 38 is positioned in the fracturing sub 22 corresponding to the desired fracture position, the formation 14 is hydraulically fractured with fracture fluid provided through the internal fracturing assembly 38 as is described in more detail below, and the internal fracturing assembly 38 thereafter recovered. To fracture the formation 14 in more than one location, the fracture mandrel 40 is operated at a fracturing sub 22 corresponding to a first fracturing position, withdrawn from the first fracturing sub 22 and drawn into second fracturing sub 22 corresponding to a second fracturing position. The fracture mandrel 40 is thereafter operated in the second fracturing sub 22, and the process repeated, if desired, for subsequent fracturing positions. Although depicted in figures as beginning by fracturing the formation 14 at the lowest fracturing sub 22, one may choose to begin fracturing at any of the fracturing subs 22 and thus position the fracture mandrel 40 in a fracturing sub 22 other than the lowest fracturing sub 22. Furthermore, fewer than all of the fracturing subs 22 provided in the lower completion string 20 may be used in fracturing the formation 14. For example, it may be desirable at the time of completion to fracture the formation 14 in fewer positions than the number of provided fracturing subs 22. In such an example, the desired fracturing subs 22 are used to fracture the formation 14 and the remaining fracturing subs 22 remain unused. Upon completing fracturing, the internal fracturing assembly 38 is recovered and the well may thereafter be produced.

In each instance as the internal fracturing assembly 38 is drawn up into a fracturing sub 22, the drag block 42 will encounter resistance as it engages a sleeve member 58 and lifts the sleeve member 58 to abut the shoulder 56 of the fracturing sub 22 (see FIG. 3A) or presses the sleeve member 58 against the shear pin 61 (see FIG. 3B). As noted above, with the drag block 42 engaged to the sleeve member 58, the window 64 of the fracture mandrel 40 substantially coincides with the window 60 of the sleeve member 58, and with the sleeve member 58 abutting the shoulder 56 the windows 64 and 60 substantially coincide with the jet apertures 54 of the fracturing sub 22. Such an arrangement with coinciding windows 64 and 60 and jet apertures 54 is referred to herein as the fracture mandrel 40 and fracturing sub 22 being in "fracturing position." Therefore, the resistance not only acts as a signal to the operator controlling the movement of the internal fracturing assembly 38 that the internal fracturing assembly 38 has encountered and engaged a fracturing sub 22, but that the fracturing sub 22 and fracture mandrel 40 are in fracturing position. To bypass a fracturing sub 22, the drag block 42 is disengaged from the sleeve member 58 and drawn through and out of the fracturing sub 22 to the next fracturing sub 22. In the illustrative implementation described herein using ball locks 68, the internal fracturing assembly 38 is rotated clockwise to disengage from the sleeve member 58. As noted above, the invention is not limited to the particular ball lock configuration described above, but can utilize any of various other configurations operable to selectively engage and disengage the drag block 42 and sleeve member 58, for example, by J-lock, actuatable collets, or other configurations known to one skilled in the art.

Accordingly, starting with the fracture mandrel 40 below the first fracturing sub 22, the internal fracturing assembly 38 is drawn up until it meets resistance. Such resistance indicates that the drag block 42 has engaged the sleeve member 58 and lifted the sleeve member 58 so that the fracture mandrel 40 and fracturing sub 22 are in fracturing position. If it is not desired to fracture the formation 14 using the lowest fracturing sub 22, the internal fracturing assembly 38 is disengaged from and drawn out of the lowest fracturing sub 22. As the internal fracturing assembly 38 is drawn up through the lower completion string 20 it will encounter resistance at each fracturing sub 22 as the drag block 42 engages the sleeve member 58 of the respective fracturing sub 22 and the fracture mandrel 40, sleeve member 58 and fracturing sub body portion 50 achieve the fracture position. To bypass a fracturing sub 22, the drag block 42 must be disengaged from the sleeve member 58 and the internal fracturing assembly 38 drawn out of the fracturing sub 22.

When the internal fracturing assembly 38, and thus fracture mandrel 40, is in a desired fracturing sub 22 and the fracture position, high pressure fracture fluids, typically containing a proppant, are introduced through the working string 27 to the interior of the internal fracturing assembly 38. The jet apertures 54 operate as nozzles to consolidate the pressurized fracture fluids into jets that penetrate the formation 14 and form fissures 74. As the fissures 74 are formed, proppant in the fracture fluids is deposited into the fissures 74 to prevent the fissures 74 from closing. The specific hydraulic fracturing process is similar to that disclosed in U.S. Pat. Nos. 5,765,642 and 5,499,678 and otherwise known in the art.

After the formation 14 has been fractured at the first position, the internal fracturing assembly 38 is disengaged from the fracturing sub 22. However, in an implementation having shear pins 61 (FIG. 3B), the internal fracturing assembly 38 is pulled to shear the shear pins 61 prior to disengaging from the fracturing sub 22. The internal fracturing assembly 38 is drawn up through and out of the fracturing sub 22 until it meets resistance again. Such resistance indicates the drag block 42 has engaged the sleeve member 58 of the adjacent fracturing sub 22 and the fracture mandrel 40 is in fracture position. If it is desired to fracture at the adjacent fracturing sub 22, the fracturing fluid is introduced as above. If it is not desired to fracture at the adjacent fracturing sub 22, the drag block 42 is disengaged from sleeve member 58 and the process repeated until the formation 14 is fractured at each desired position.

In a vertical or inclined borehole, gravity may cause the sleeve members 58 to drop out of fracturing position after the internal fracturing assembly 38 is removed from the fracturing sub 22. Movement out of fracturing position will close off the ports 54 to substantially prevent re-entry of proppant from the fracture fluids, especially during production. In general it is desirable to ensure that the sleeve member 58 is out of fracturing position, that is, make sure the windows 60 of the sleeve member 58 do not coincide with the jet apertures 54 of the fracturing sub 22. To this end, the sleeve member 58 can be set out of fracturing position after the internal fracturing assembly 38 is drawn out of a fracturing sub 22 by running the internal fracturing assembly 38 back into the fracturing sub 22. The drag block 42 will engage the sleeve member 58 and push it downward out of the fracture position. Thereafter, drag block 42 is disengaged from the sleeve member 58.

Figure 7:
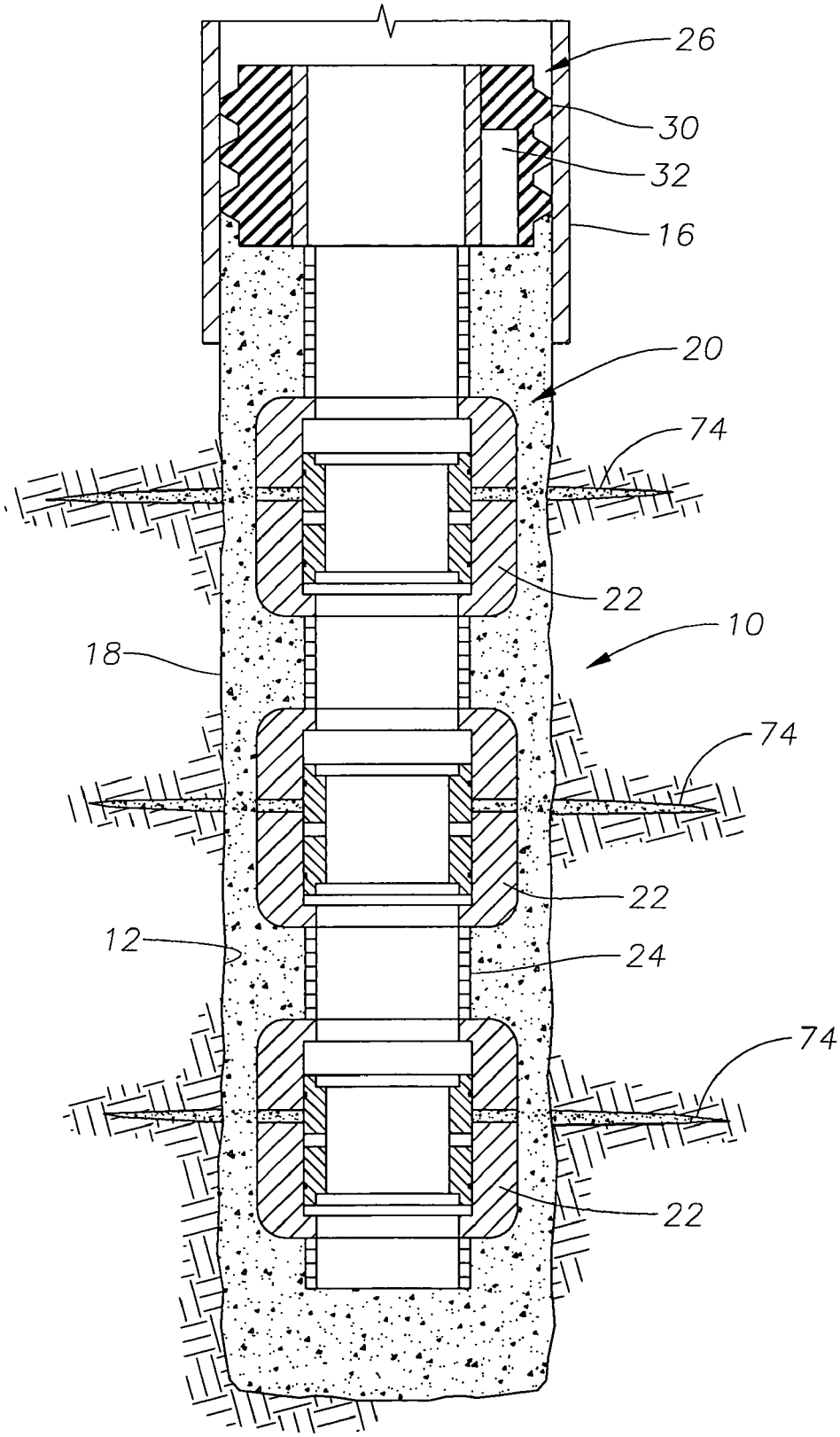

After the formation 14 has been fractured as is desired, the working string 27, crossover tool 28 and internal fracturing assembly 38 are recovered to the surface (FIG. 7). The lower completion string 20 is left in the borehole 12 and the packer system 26 is maintained in sealing engagement with the interior of the casing 16. The formation 14 can thereafter be produced through the lower completion string 20 and casing 16. In production, well production fluids (gas, oil and water) from the formation 14 enter the interior of the lower completion string 20 through the sand control assemblies 24 and pass to the surface through the interior of the lower completion string 20, casing 16 and a production string. It will be understood by those skilled in the art that in most instances a production string (not shown) will be run in the hole after removal of the working string 27 and will be connected to packer 26. Well production fluids will flow or be pumped to the surface via such a production string. It will also be understood by those skilled in the art that working string 27 may be left in the well connected to packer 26 and be used to as a production string produce the well and/or for future gravel packing and fracturing treatments.

Because the lower completion string 20 remains in the borehole 12, the formation 14 can be later re-fractured at one of the fracturing subs 22 initially fractured or fractured for the first time at one of the unutilized fracturing subs 22. To fracture or re-fracture the formation 14, the internal fracturing assembly 38 can be run back into the borehole 12 and repositioned as in FIGS. 1A and 1B. The fracturing process can then be repeated as discussed above.

Of note, gravel packing a borehole differs from frac-packing a borehole in that frac-packing involves depositing a particulate (fracturing fluid proppant) that has been selected for the purposes of the fracturing process using the fracturing fluid. In other words, the particulate is selected for its permeability when packed in relation to the permeability of the formation, and is admixed into the fracturing fluid. As the fracturing fluid at pressure fractures the formation, the proppant fills the fractures and the borehole. In contrast, gravel packing involves depositing a particulate selected for its filtering properties to reduce passage of fines into the production string. The gravel packing is introduced in a separate process than the fracturing, and is usually introduced into an annulus between a borehole and a screen.

Fracturing, running-in the completion string, and gravel packing according to the disclosed system method can be performed in a single trip into the borehole. Thereafter only the internal fracturing assembly need be retrieved. In previous systems requiring multiple trips into the borehole, fracturing, running-in the completion string, and gravel packing can take weeks if not months. Using the system and method described herein, the completion can take only a matter of days.

Also, the system and method enable the borehole to be fractured at precise locations corresponding to the fracture subs. The formation can be fractured at all or less than all of the fracture subs, enabling the formation to be fractured in stages (fracture at one position, produce, fracture at a second position, produce, etc.) to account for changes in the production characteristics over the life of the well.

A number of implementations of the invention have been described. Nevertheless, it will be understood that various modifications may be made without departing from the spirit and scope of the invention. Accordingly, other implementations are within the scope of the following claims.

What is claimed is:

1. A system for fracturing an earth formation surrounding a borehole, comprising:

a conduit adapted for fixed installation in the borehole;

a seal adapted to substantially seal an annulus between the conduit and the borehole;

a flow assembly selectively communicating between the flow assembly and an interior of the conduit and between the flow assembly and an annulus between the conduit and the borehole downhole of the seal;

at least one ported sub coupled to the conduit and having at least one substantially lateral aperture therein, the substantially lateral aperture adapted to communicate fluids within the conduit into the borehole to fracture the earth formation; and a substantially tubular internal fracturing assembly insertable into the interior of the ported sub, the internal fracturing assembly adapted to communicate an interior of the internal fracturing assembly to one or more of the lateral apertures.

2. The system of claim 1 wherein the flow assembly comprises a crossover tool changeable between communicating between a first side of the crossover tool and an interior of the conduit on a second side of the crossover tool and communicating between the first side of the crossover tool and an annulus between the conduit and the borehole on the second side of the crossover tool.

3. The system of claim 1 wherein at least one ported sub comprises a plurality of ported subs and the internal fracturing assembly is selectively postionable in at least two of the ported subs.

4. The system of claim 1 wherein the conduit comprises at least one flow aperture adapted to allow flow between an interior and an exterior of the conduit.

5. The system of claim 1 further comprising a second conduit in the borehole; and wherein the flow assembly is adapted to communicate between an interior of the second conduit on a first side of the flow assembly and the annulus between the first conduit and the borehole on the second side of the flow assembly.

6. The system of claim 1 further comprising a second conduit in the borehole; and wherein the flow assembly is adapted to communicate between an interior of the first conduit on the second side of the flow assembly and an annulus between the second conduit and the borehole on the first side of the flow assembly.

7. The system of claim 1 wherein the conduit comprises a sand control assembly adapted to filter entry of particulate into the interior of the conduit.

8. The system of claim 1 wherein the at least one lateral aperture of the at least one ported sub is selectively changeable between allowing flow and substantially blocking flow through the at least one lateral aperture.

9. The system of claim 1 wherein the seal is adapted to be positioned in a portion of the borehole having a casing while the ported sub is positioned in an uncased portion of the borehole.

10. The system of claim 1 wherein at least one of the lateral aperture of the ported sub and the internal fracturing assembly comprises a nozzle adapted to direct fluids into the borehole to fracture the earth formation.

11. The system of claim 10 wherein the nozzle is adapted to jet fluids into the borehole to fracture the earth formation.

12. The system of claim 1 wherein the ported sub further comprises a sleeve member positionable to substantially block flow trough at least one lateral aperture and positionable to allow flow through the at least one lateral aperture.

13. The system of claim 12 wherein the sleeve member is provided with a window that substantially coincides with at least one lateral aperture when the sleeve member is positioned to allow flow through the at least one lateral aperture.

14. The system of claim 12 wherein the sleeve member is held in a position to allow flow through the at least one lateral aperture.

15. The system of claim 14 wherein the sleeve member is held in position with at least one of a shear pin, a circlip, a ball lock, and a J-lock.

16. The system of claim 12 wherein the internal fracturing assembly is adapted to selectively engage the sleeve member and change the position of the sleeve member from substantially blocking flow through at least one lateral aperture to allowing flow through the at least one lateral aperture.

17. The system of claim 1 wherein the internal fracturing assembly has an open end and a valve positioned in the open end, the valve being configured to allow flow from within the borehole into the internal fracturing assembly and substantially block flow from within the internal fracturing assembly into the borehole.

18. The system of claim 17 wherein the valve is a ball received in the open end and substantially block flow from within the internal fracturing assembly into the borehole.

19. The system of claim 1 further comprising at least one shunt conduit extending substantially axially along the conduit on the second side of the flow assembly and adapted to communicate fluid along at least a portion of a length of the conduit.

20. The system of claim 19 wherein the at least one shunt conduit is at least two shunt conduits of adapted to communicate fluid to at least two different locations along the length of the conduit.

21. A method of fracturing and gravel packing a borehole in an earth formation, comprising:

positioning a completion string in a borehole, the completion string having at least one filter assembly adapted to filter entry of particulate from an exterior of the completion string into an interior of the completion string and having at least one fracturing sub;

sealing an annulus between the completion string and the borehole;

flowing a gravel packing slurry around the at least one filter assembly into the annulus between the completion string and the borehole via a passage between the seal and the filter assemblies;

fracturing the earth formation with the at least one fracturing sub; and producing fluids from the earth formation through the completion string.

22. The method of claim 21 wherein fracturing the earth formation with the fracturing sub comprises introducing fluid through the fracturing sub to impinge on and fracture the earth formation.

23. The method of claim 21 wherein positioning the completion string in a borehole comprises positioning the completion string such that the fracturing sub is at least partially in an uncased portion of the borehole.

24. The method of claim 21 further comprising changing the fracturing sub from allowing flow of fluid between the interior of the completion string and the annulus between the completion string and the borehole to substantially blocking flow of fluid between the interior of the completion string and the annulus between the completion string and the borehole.

25. The method of claim 21 wherein the filter assembly comprises at least one of a sand screen and a slotted pipe.

26. The method of claim 21 wherein the completion string comprises a crossover tool; and wherein flowing gravel packing slurry around the at least one filter assembly into the annulus between the completion string and the borehole further comprises flowing gravel packing slurry from an interior of the crossover tool into the annulus between the completion string and the borehole.

27. The method of claim 21 wherein flowing gravel packing slurry around the at least one filter assembly comprises flowing gravel packing slurry through a lateral aperture of a internal fracturing assembly positioned in the completion string into a lateral passage in the completion string communicating the lateral aperture of the internal fracturing assembly with the annulus between the completion string and the borehole.

28. The method of claim 21 wherein the completion string comprises at least two axially spaced fracturing subs and the method further comprises fracturing the formation in at least two axially spaced positions by introducing fluid through at least two axially spaced fracturing subs to impinge on a sidewall of the borehole.

29. The method of claim 28 wherein fluid is introduced through at least two axially spaced fracturing subs one at a time.

30. The method of claim 21 wherein the completion string has at least two axially spaced fracturing subs and the method further comprises:

fracturing the earth formation with fewer than all of the fracturing subs;

producing fluids from the earth formation through the completion string;

ceasing production of fluids; and after ceasing production of fluids, fracturing the earth formation with at least one fracturing sub.

31. The method of claim 30 wherein fracturing the earth formation with at least one fracturing sub after ceasing production of fluids comprises fracturing the earth formation with at least one fracturing sub that was not previously used in fracturing the earth formation.

32. The method of claim 21 further comprising:

positioning an internal fracturing assembly in the fracturing sub, the internal fracturing assembly adapted to communicate fluid to the fracturing sub; and wherein fracturing the earth formation with the fracturing sub comprises flowing fracturing fluid front the internal fracturing assembly through the fracturing sub to fracture the earth formation.

33. The method of claim 32 wherein the completion string has a plurality of axially spaced fracturing subs and the internal fracturing assembly is selectably positionable in at least two of the plurality of axially spaced fracturing subs.

34. The method of claim 32 further comprising positioning the completion string and internal fracturing assembly in the borehole in the same run into the borehole.

35. The method of claim 21 wherein flowing gravel packing slurry around the at least one filter assembly comprises positioning an internal fracturing assembly having at least one lateral aperture with the at least one lateral aperture above the completion string and flowing gravel packing slurry through the internal fracturing assembly and out the lateral aperture into the annulus between the completion string and the borehole.

36. The method of claim 26 wherein fracturing the earth formation comprises positioning the internal fracturing assembly in the at least one fracturing sub and flowing fracturing fluid through the internal fracturing assembly into the at least one fracturing sub to fracture the formation.

37. The method of claim 36 wherein fracturing the earth formation comprises positioning the internal fracturing assembly in the at least one fracturing sub and flowing fracturing fluid through the internal fracturing assembly into at least one fracturing sub to fracture the formation.

38. A method of fracturing an earth formation, comprising:

positioning a completion string in a borehole;

gravel packing an annulus between the completion string and the borehole through a crossover valve having an passage to the annulus; and without removing the completion string, fracturing the earth formation in a plurality of axial positions.

39. The method of claim 38 further comprising, before producing fluid from the earth formation, fracturing the earth formation.

40. The method of claim 38 wherein fracturing the earth formation comprises:

positioning an internal fracturing assembly in a first fracturing sub such that fluid in the internal fracturing assembly is communicated to the fracturing sub;

introducing fracturing fluid into the internal fracturing assembly to the first fracturing sub to fracture the formation;

positioning the internal fracturing assembly in a second fracturing sub such that fluid in the internal fracturing assembly is communicated to the second fracturing sub; and introducing fracturing fluid into the internal fracturing assembly to the second fracturing sub to fracture the formation.

41. The method of claim 38 further comprising repeating the following one or more times:

producing fluids from the earth formation through the completion string;

ceasing production of fluids from the earth formation; and without removing the completion string, fracturing the earth formation.

42. A method of fracturing earth formation, comprising:

positioning completion string in a borehole;

gravel packing an annulus between the completion string and the borehole through a crossover valve having an passage to the annulus;

without removing the completion string, fracturing the earth formation;

producing fluids from the earth formation through the completion string;

ceasing production of fluids from the earth formation; and without removing the completion string, fracturing the earth formation again.

43. The method of claim 42 further comprising, before producing fluids from the earth formation, fracturing the earth formation.

44. The method of claim 43 wherein fracturing the earth formation before producing fluids from the earth formation comprises fracturing the earth formation in a plurality of axial position.

45. A method of fracturing an earth formation, comprising:

positioning a completion string in a borehole;

gravel packing an annulus between the completion string and the borehole through a crossover valve having an passage to the annulus;

without removing the completion string, fracturing the earth formation; and wherein fracturing the earth formation comprises introducing fracturing fluid into a fracturing sub and directing, the fluid to fracture the earth formation.

46. The method of claim 45 wherein introducing fracturing fluid into the fracturing sub comprises positioning an internal fracturing assembly in the fracturing, sub such that fluid in the internal fracturing assembly is communicated to the fracturing sub.

47. The method of claim 45 wherein after the earth formation is fractured with the fracturing sub, changing the fracturing sub from allowing flow of fluid between an interior of the completion string and an annuls between the completion string and the borehole to substantially blocking flow of fluid between the interior of the completion string and an annulus between the completion string and the borehole.

48. The method of claim 45 wherein fracturing the earth formation comprises fracturing the formation in a plurality of axial positions.

* * * * *